US009917374B2

(12) United States Patent
Gruener et al.

(10) Patent No.: US 9,917,374 B2
(45) Date of Patent: Mar. 13, 2018

(54) DUAL-BAND PHASED ARRAY ANTENNA WITH BUILT-IN GRATING LOBE MITIGATION

(71) Applicant: AIRBUS DS ELECTRONICS AND BORDER SECURITY GMBH, Taufkirchen (DE)

(72) Inventors: Wilhelm Gruener, Ulm (DE); Peter Feil, Ulm (DE)

(73) Assignee: AIRBUS DS ELECTRONICS AND BORDER SECURITY GMBH, Taufkirchen (DE)

( * ) Notice: Subject to any disclaimer, the term of this patent is extended or adjusted under 35 U.S.C. 154(b) by 0 days.

(21) Appl. No.: 15/190,650

(22) Filed: Jun. 23, 2016

(65) Prior Publication Data

US 2016/0380360 A1 Dec. 29, 2016

(30) Foreign Application Priority Data

Jun. 26, 2015 (EP) ..... 15001899

(51) Int. Cl.

| | |
|---|---|
| ***H01Q 1/38*** | (2006.01) |
| ***H01Q 21/06*** | (2006.01) |
| ***H01Q 3/26*** | (2006.01) |
| ***H01Q 5/00*** | (2015.01) |
| ***H01Q 21/00*** | (2006.01) |
| ***H01Q 21/20*** | (2006.01) |
| ***H01Q 5/392*** | (2015.01) |
| ***H01Q 1/36*** | (2006.01) |

(52) U.S. Cl.

CPC ..... *H01Q 21/061* (2013.01); *H01Q 1/36* (2013.01); *H01Q 3/26* (2013.01); *H01Q 5/00* (2013.01); *H01Q 5/392* (2015.01); *H01Q 21/0025* (2013.01); *H01Q 21/20* (2013.01)

(58) Field of Classification Search

CPC .. H01Q 1/38; H01Q 5/00; H01Q 3/26; H01Q 21/061; H01Q 5/392

USPC ..... 343/700 MS

See application file for complete search history.

(56) References Cited

U.S. PATENT DOCUMENTS

| | | | |
|---|---|---|---|
| 3,270,336 | A | 8/1966 | Birge |
| 3,811,129 | A | 5/1974 | Holst |

(Continued)

FOREIGN PATENT DOCUMENTS

| | | | |
|---|---|---|---|
| EP | 2613169 | A1 | 7/2013 |
| WO | 2007136333 | A1 | 11/2007 |

OTHER PUBLICATIONS

European Search Report completed on Nov. 30, 2015 in related EP Application No. 15 00 1899.2.

(Continued)

*Primary Examiner* — Huedung Mancuso

(74) *Attorney, Agent, or Firm* — Patent Portfolio Builders PLLC

(57) ABSTRACT

A dual-Band phased array antenna with built-in grating lobe mitigation includes an array of radiating elements capable of working at both bands and arranged at distances small enough, avoiding grating lobes with respect to the lower band within the desired field of view. The radiating elements are arranged in planar subarrays that can be steered independently from each other and each of the subarrays has a different boresight normal vector, so that grating lobes in the upper band is mitigated.

11 Claims, 5 Drawing Sheets

(56) References Cited

U.S. PATENT DOCUMENTS

| | | | | |
|---|---|---|---|---|
| 5,581,517 | A * | 12/1996 | Gee | G01S 7/52046 367/11 |
| 6,114,998 | A * | 9/2000 | Schefte | H01Q 1/243 343/700 MS |
| 6,292,134 | B1 | 9/2001 | Bondyopadhyay | |
| 6,650,291 | B1 * | 11/2003 | West | H01Q 3/46 342/371 |
| 6,836,255 | B1 * | 12/2004 | Davis | H01Q 1/288 343/781 P |
| 7,034,753 | B1 | 4/2006 | Elsallal et al. | |
| 8,350,771 | B1 * | 1/2013 | Zaghloul | H01Q 9/0435 343/700 MS |
| 2008/0094301 | A1 | 4/2008 | Lee et al. | |
| 2010/0328188 | A1 * | 12/2010 | Chang | H01Q 21/064 343/893 |
| 2014/0375525 | A1 | 12/2014 | Shi | |

OTHER PUBLICATIONS

Jamnejad et al., "Array Antennas for JPL/NASA Deep Space Network," Aerospace Conference Proceedings, 2002. IEEE (vol. 2), Mar. 9-16, 2002, pp. 2-911-2-921 vol. 2, Big Sky, MT, US.

Krivosheev et al., "Grating Lobe Suppression in Phased Arrays Composed of Identical or Similar Subarrays," 2010 International Symposium on Phased Array Systems and Technology (ARRAY), Oct. 12-15, 2010, pp. 724-730, Waltham, MA, US.

Sheehan et al., "Satellite-borne active phased array techniques for mobile communications," IEE Proceedings section A a I, Jul. 1986, pp. 339-344, vol. 133, Pt. F, No. 4, Stevenage, Herts, GB.

* cited by examiner

DUAL-BAND PHASED ARRAY ANTENNA WITH BUILT-IN GRATING LOBE MITIGATION

CROSS-REFERENCE TO RELATED APPLICATIONS

The present application claims priority under 35 USC § 119 to European Patent Application Number 15 001 899.2, filed Jun. 26, 2015, the entire content of which is herein expressly incorporated by reference.

BACKGROUND OF THE INVENTION

Exemplary embodiments of the invention relate to a dual-band phased array antenna with built-in grating lobe (GL) mitigation.

In the field of phased array antennas it is well-known that the radiating elements (REs) must have a distance of less than half of the shortest wavelength radiated by the antenna to enable a scanning area of the antenna with a broad beam width. Associated with each radiating element is a phase shifting device or a time delaying device to enable the electronic scanning by the phased array antenna. In modern phased array antennas there are additional power amplifiers for transmission and low noise amplifiers for receiving, as well as RF switches and electronic circuits for control integrated into transmit receive modules (TRMs) behind each radiating element. These antennas are called active electronically scanned arrays (AESA) and consist of a large number of TRMs. It is also well-known that the beam width of an antenna is inversely proportional to the array diameter measured in wavelength. In order to achieve small antenna beams a large number of TRMs is required, which may be expensive.

Performance of a radar with search tasks is mainly characterized by its power-aperture product, where the aperture is built-up of the sum of the radiating element areas. As well-known from the phased array theory, the distance of the radiating elements has to be on the order of half a wavelength or smaller to guarantee a wide grating lobe-free electrical scan angle Θ. The relation between the attainable grating lobe-free scan angle Θ and the corresponding maximal distance d between the radiating elements is as follows:

$$d < \lambda \cdot \frac{1}{1 + \sin\frac{\Theta}{2}}.$$

In the following this relation is referred to as the "λ/2 condition".

This means that achieving a grating lobe-free scan over the full hemisphere (Θ=180° requires the maximum distance d between the radiating elements to be smaller than λ/2 as mentioned before. If the required grating lobe-free scan angle is smaller, e.g. 90°, the resulting distance d between the radiating elements can be larger (d<0.59*λ).

Antennas with high gain require a relatively high number of radiating elements, which may become expensive taking into account that for each radiating element an associated TRM is needed.

Increasing the size of the radiating elements will result in larger antenna aperture, smaller antenna beams, higher antenna directivity, and better angular resolution but with the drawback of grating lobes, especially at large scanning angles. Lowering the operation frequency would reduce or avoid the grating lobe problems, but antenna beam width would increase, directivity and angular resolution decrease, which is not in favor of exact angular position estimation tasks.

To avoid two separate electronically steered antennas—one for the lower band (e.g. S-Band) and one for the upper band (e.g. X-band)—prior art antennas, as disclosed in the U.S. Pat. No. 7,034,753, use a special partitioning of the array in upper frequency areas and lower frequency areas, whereas in each area an antenna grid is used that fulfills the half wavelength condition. As only the corresponding area is used for each radio frequency no grating lobes are expected in the whole angular scanning area. The disadvantage of this solution is that only a part of the aperture can be used for each operating frequency, with well-known degradations of the radar performance with respect to the detection range.

Suppression or mitigation of grating lobes is also known from prior art. One known solution is the use of the patterns of the radiators to suppress the grating lobe. For arrays that are only steered to boresight of the array, the patterns of the radiators can be designed in this way so that the nulls will coincide with the grating lobe of the array. As a result the grating lobe are significantly reduced. The grating lobe will, however, appear if the array is electronically steered, as the grating lobe will move with the main lobe (ML) whereas the nulls of the radiator will stay, so that the grating lobe will be visible and may become as large as the main beam. To avoid the strong increase of grating lobe during electronically steering of the array, the radiator can be designed to have some overlapping area, so that the pattern of the radiator will become small, that the grating lobe will be outside this pattern as described, for example, in US Patent Document 2014/0375525 A1. A disadvantage of this method is the strongly reduced scanning area for the main beam, as the pattern of the radiator may become very small.

Another method to mitigate the grating lobe of arrays that infringes the half wavelength condition is the use of irregular grids for the arrangement of radiators on the array. In this case the grating lobe will smear over a broad region and therefore the grating lobe will be well below the main beam over a wide scanning area. U.S. Pat. No. 3,811,129 describes such a method for grating lobe mitigation. The disadvantage is that it leads to a difficult manufacturing of irregular arrangements of the radiators, which makes the method very expensive.

A further method to mitigate the system wide impact on radar systems is the special design of the transmit pattern of separate transmit antennas, as disclosed in U.S. Pat. No. 3,270,336. In this case a second antenna is introduced.

In KRIVOSHEEV, Yury V.; SHISHLOV, Alexandr V. "GL suppression in phased arrays composed of identical or similar subarrays". In: Proceedings of Symposium on Phased Array Systems and Technology. Waltham-Boston. 2010. S. 724-730, where subarrays are displaced, or slightly rotated in a plane arrangement against each other, in order to displace the grating lobe of the subarrays, so that a zero in the grating lobe of the whole array is placed. With these methods grating lobe reduction up to approximately 5 dB is reported. The disadvantage of the method is that the number of subarrays that can be arranged is practically very limited.

Jamnejad, V.; Huang, J.; Levitt, B.; et. al., "Array antennas for JPL/NASA Deep Space Network," in Aerospace Conference Proceedings, 2002. IEEE, vol. 2, no., pp. 2-911-2-921 vol. 2, 2002 doi: 10.1109/AERO.2002.1035672 explains that for phased array antennas grating lobes can be prevented if the radiating elements are spaced approximately half the wavelength apart. Further, a multi-frequency operation capability of phased array antennas can be achieved by stacking or interleaving array elements at two or more frequencies. In another example, this document describes an arrangement of subarrays on a semi-spherical surface with different boresight normal vectors of each subarray in order to achieve a hemispherical coverage of the antenna beam. Beam scanning is provided by a combination of switching the appropriate subarrays on or off and by providing beam steering of each individual subarray.

European Patent Document 2 613 169 A1 discloses a further method for grating lobe mitigation. This method digitally distinguishes main lobe from grating lobe and side lobe detections by applying receive weights to return radar data for each radar receive element to steer each subarray of an array radar antenna to a direction other than the subarray transmit angle.

SUMMARY OF THE INVENTION

Exemplary embodiments of the present invention are directed to a dual-band phased array antenna capable of conducting a wide angular search in the lower band and having precise tracking capability in the upper band without suffering from grating lobes.

A dual-band phased array antenna is disclosed with a grating lobe free wide angular scanning for the low band (e.g. S-Band, e.g. in the range of 2.3-2.5 GHz) operation and a grating lobe suppression at the upper (high) band (e.g. X-Band, e.g. 10 GHz) operation.

The dual-band phased array antenna with built-in grating lobe mitigation comprises, beside state of the art electronically and/or analog processing components, an array of radiating elements capable of working at both bands and arranged at distances that are compatible with the $\lambda/2$ condition for avoiding grating lobes with respect to the lower band. The radiating elements are arranged in planar subarrays that can be steered independently from each other. Each of the subarrays has a different boresight normal vector.

As an example, when the operation is planned for S- and X-Band the distances between radiating elements in all cardinal directions (e.g. x/y direction in a two-dimensional array) are optimized for the S-Band frequency range, meaning that the distances between the radiating elements fulfill the $\lambda/2$ condition for the S-Band frequency range.

As a result of the different boresight normal vector, the subarrays may be arranged on a regular or irregular polyhedral surface. In a preferred example the subarrays may be arranged in such a way that the centers of the subarrays are lying tangentially on the surface of a virtual sphere (similar to a part of the surface of a mirror ball).

The subarrays comprise a plurality of radiating elements flatly arranged on the subarray carrier structure, that means lying on a plane formed by the x,y-axis, where the z-axis is representing the orthogonal transmit or receive direction (boresight direction). The radiating elements preferably are capable to work on both bands with low losses and good impedance matching. Radiating elements fulfilling this condition are, for example, ridge waveguide horns.

The normal vector of a subarray represents the individual boresight direction, which in turn defines the main lobe of the pattern of the array.

The form and size of the individual subarrays may be the same or different. The arrangement of the subarrays forms the overall shape of the antenna, which may be circular, rectangular or quadratic as seen in the boresight direction of the antenna. However, the shape is not limited to these particular embodiments.

The invention can be used on all kind of arrays for linear, 2D or 3D arrays (e.g. planar or spherical array structures, etc.).

The whole antenna may be fixedly installed or mounted on a mechanically steerable gimbal system to steer the whole antenna mechanically to a direction, which may be the center of an electronically scanned field of view.

Using this design of the invention saves approximately 90% of radiating elements with connected TRMs compared to known arrays with an antenna segmentation for the different scanning areas at the upper bands as these are used in AESA. This is a huge cost reduction due to reduced number of radiating elements required. Additionally, only one type of radiating element is required compared to arrays with special partitioning using different kind of radiating elements. Even system design is easier and less complex as compared to prior art antennas. As the resolution is improved, the array can be designed either smaller or with a better resolution using the same array size. Manufacturing is less complex as no partitioning of the antenna grid for the different applicable bands is required.

Nevertheless, the arrangement of radiating elements according to the invention allow a wide angular scan at the lower frequency band and a sufficient electronically scanning at the upper frequency band using the inventive grating lobe suppression.

With the invention, based on the described subarray arrangement, the grating lobe will be suppressed by more than 15 dB compared to a planar array (without segmentation) at a scanning angle up to +1-15°. This is a big advantage as some of other known mitigation techniques for the suppression of grating lobe do either not allow beam steering or only within very limited range e.g. about +1-5°.

BRIEF DESCRIPTION OF THE DRAWINGS

The invention may be more fully understood by the following more detailed description with corresponding figures wherein.

Figure 2:
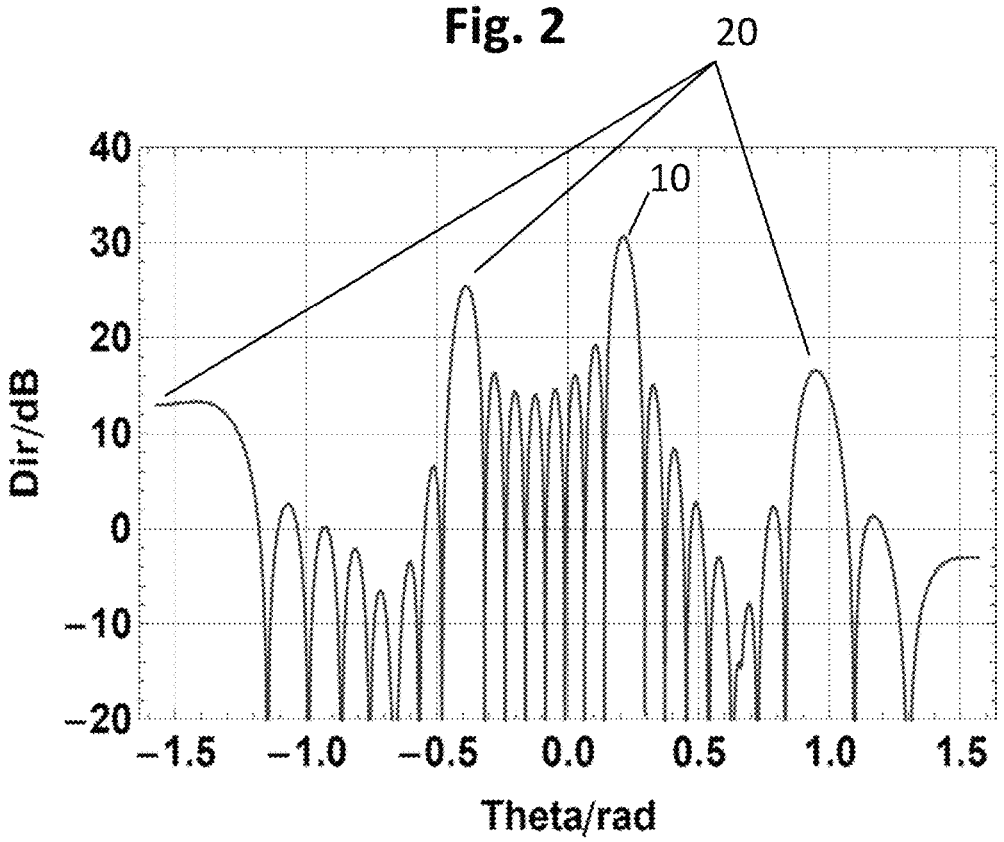

d being the distance between neighboring radiating elements,

FIG. 2 shows the antenna pattern of an array antenna with $$\left(\frac{d}{\lambda} > 0,5\right),$$

Figure 3:
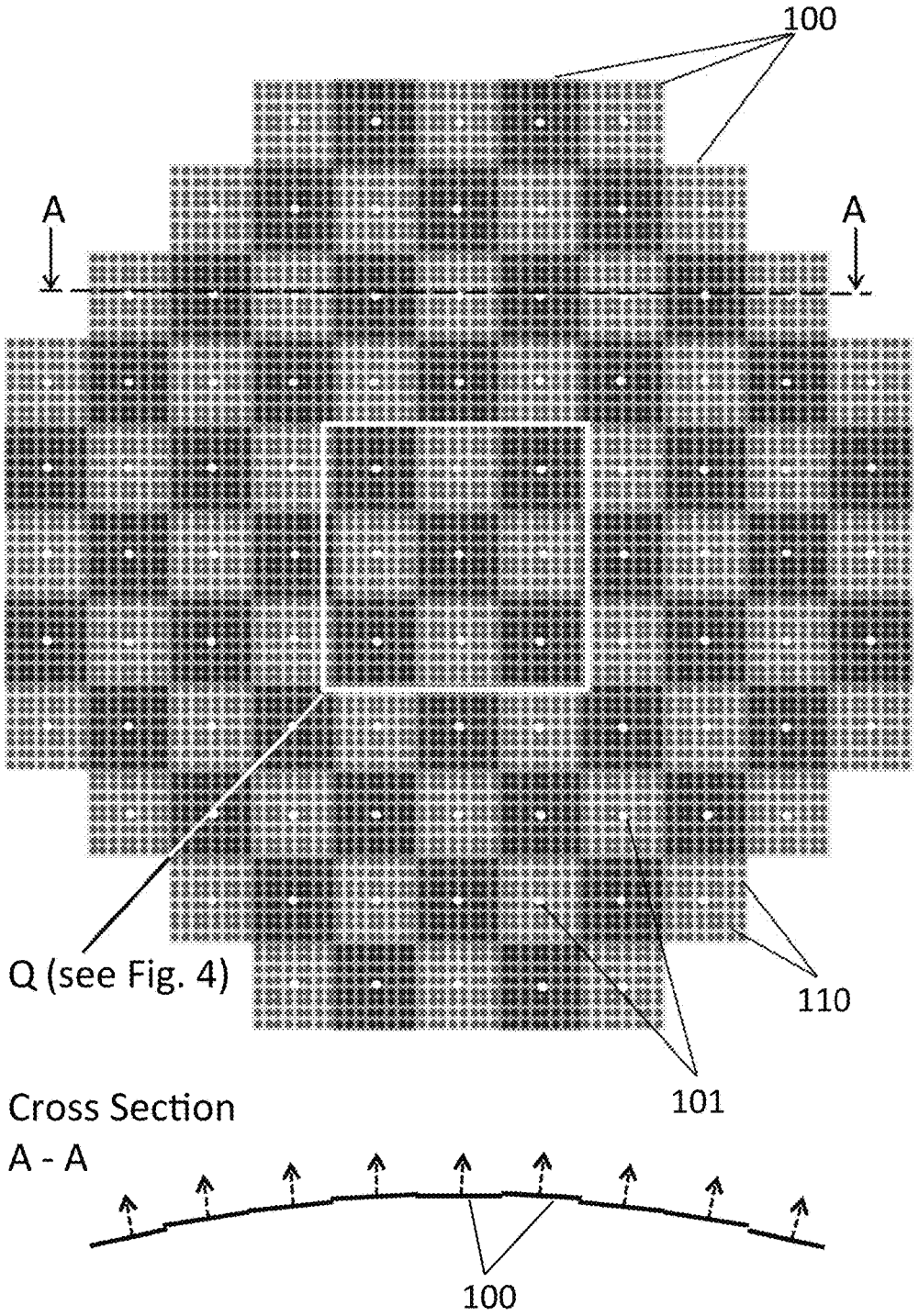
Figure 4:
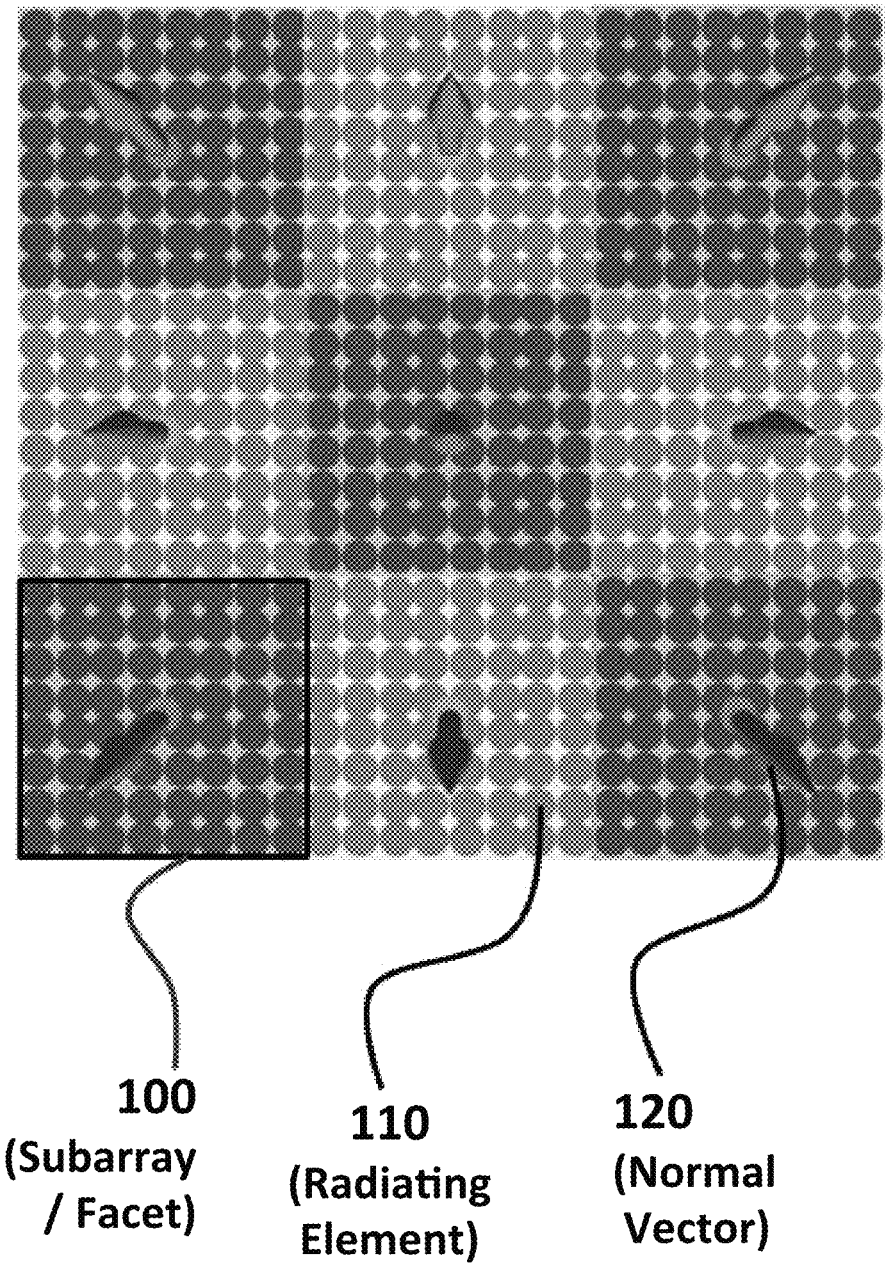
Figure 5:
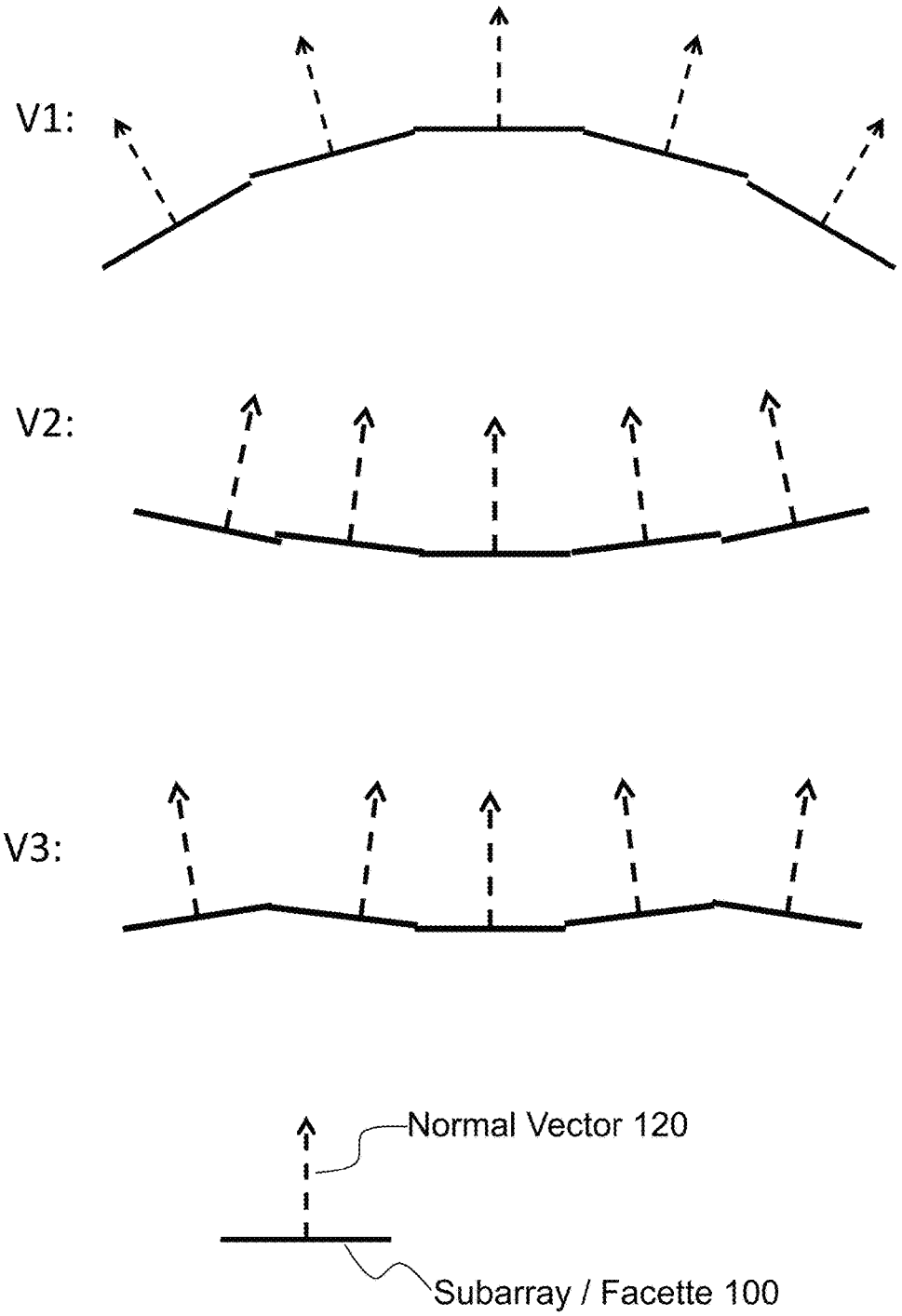
Figure 6:
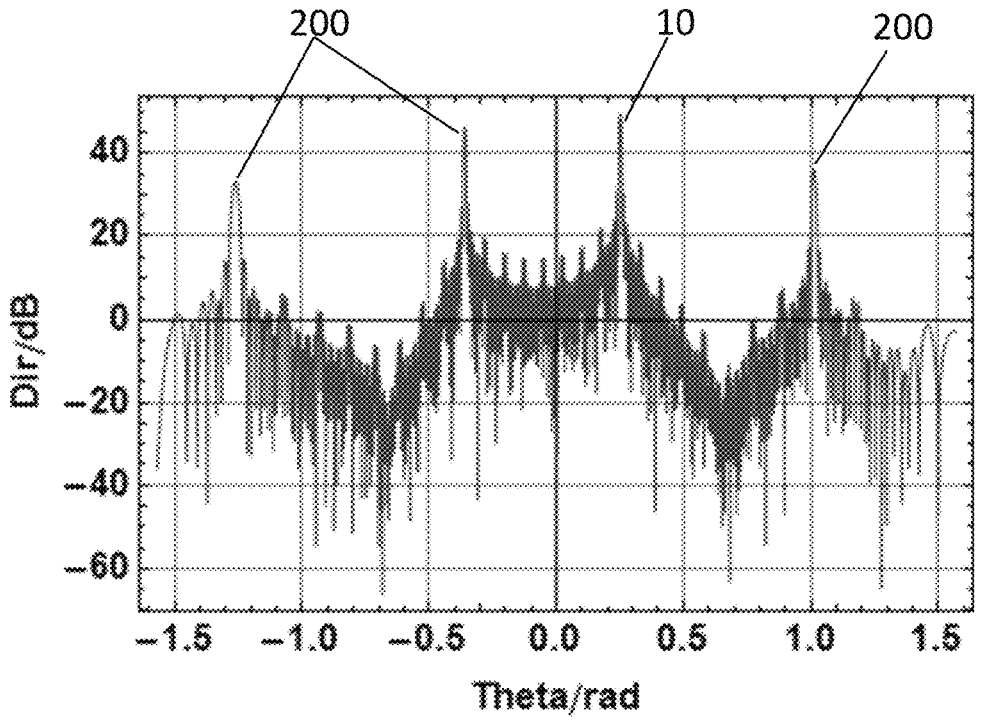
Figure 7:
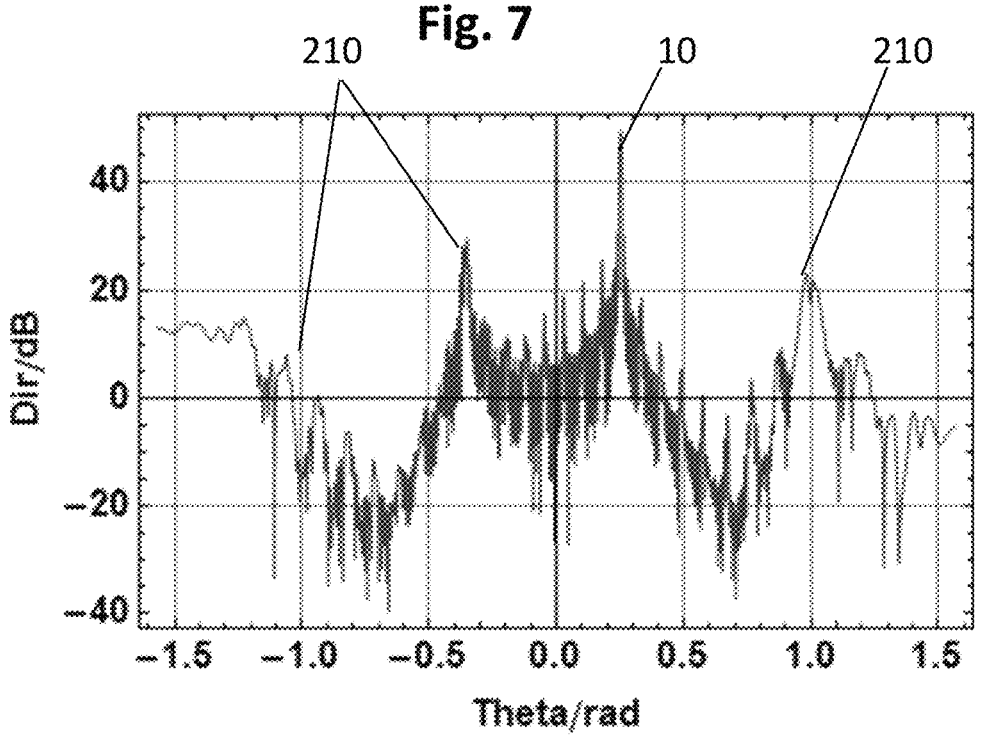

FIG. 3 shows an exemplary embodiment of the invention with 97 planar subarrays, FIG. 4 shows an excerpt from the array of FIG. 3 indicating the design and normal vectors of the subarrays, FIG. 5 shows three other embodiments of the array antenna according to the invention, FIG. 6 shows the computer simulation results indicating the pattern with a planar subarray arrangement according to the prior art, FIG. 7 shows the computer simulation results indicating the pattern using a subarray arrangement according to the present invention.

DETAILED DESCRIPTION

It is well known in phased array theory that the antenna pattern for sufficiently large arrays can be assumed to be the product of the element pattern and the array factor as in equation Eq 1, shown for a linear array, but not limited to linear arrays:

$$E(\theta) = \underbrace{E_{RE}(\theta)}_{Element\ Pattern} \underbrace{\sum_n A_n e^{-i2\pi\frac{d}{\lambda}(\sin\theta - \sin\theta_0)n}}_{Array\ Factor} \quad \text{Eq 1}$$

The first term $E_{RE}(\theta)$ in Eq 1 is called element pattern, whereas the sum is commonly known as array factor. In this second term the individual signals with amplitude $A_n$ and Phase $$2\pi\frac{d}{\lambda}(\sin\theta - \sin\theta_0)n$$

are summed. d designates the distance between neighboring radiating elements. The phase depends on the position n*d within the array, the wavelength λ, the desired direction θ and the steering direction $\theta_0$. The array factor will have maximal amplitude when the "phase" in the exponential term becomes a multiple of 2π as noted in Eq 2:

$$2\pi\frac{d}{\lambda}(\sin\theta - \sin\theta_0) = k2\pi \quad k \in \mathbb{Z} \quad \text{Eq 2}$$

Figure 1:
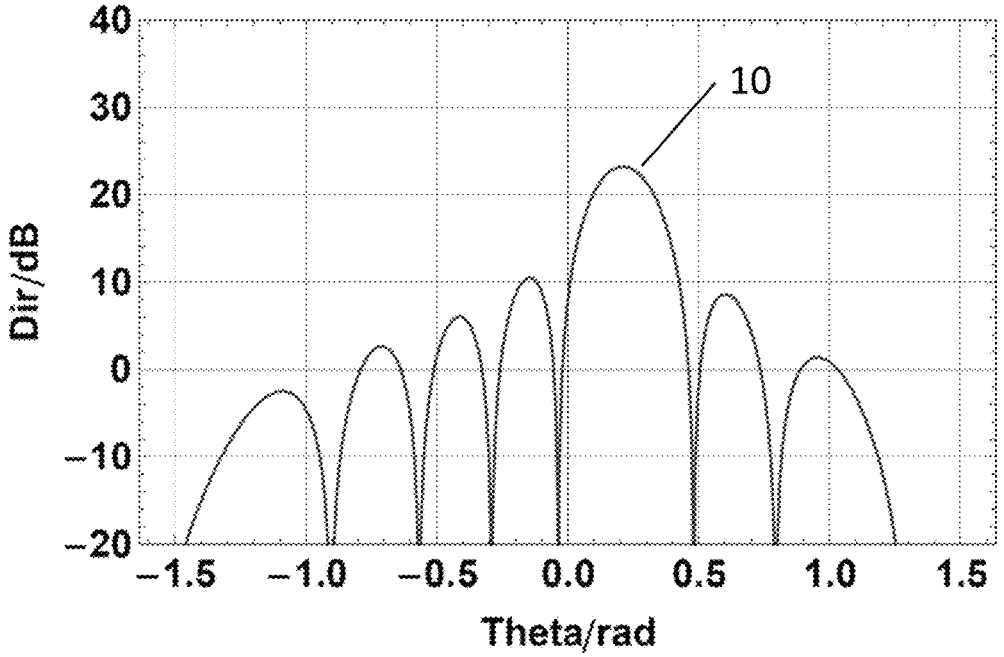
FIG. 1 shows the antenna pattern of an array antenna with $$\left(\frac{d}{\lambda} < 0,5\right),$$

If $$\frac{d}{\lambda}$$

is smaller than 0.5, Eq 2 is solvable only for k=0 and only one major lobe exists in the whole scanning range −π/2<theta<π/2 that is the so-called main lobe 10 as shown in FIG. 1 where the patterns according Eq 1 in dB above isotropic radiation is plotted. In cases where $$\frac{d}{\lambda}$$

becomes larger than 0.5 as for e.g. operating the same antenna at higher frequencies solutions with values of k different from 0 are additionally possible, which results in secondary lobes or grating lobes. The direction of the grating lobes are given as solutions of Eq 2:

The directions of the grating lobes are defined according to Eq 3

$$\theta_k = \sin^{-1}\left(\sin\theta_0 + \frac{k\lambda}{d}\right); \quad |k| < \mathrm{Int}\left[\left|\frac{d(1-\sin(\theta_0))}{\lambda}\right|\right] \quad \text{Eq 3}$$

As an example for $$\frac{d}{\lambda} = 3/2$$

the pattern of an array as in FIG. 1 with a three times higher operating frequency is shown in FIG. 2, where three grating lobes 20 can clearly be identified beside the main lobe 10. The directions of the grating lobes 20 for the above example $$\frac{d}{\lambda} = 3/2$$

according to Eq 3 are at: $\theta_{GL}=\{-1.42, -0.395, 0.951\}$.

This may be easily extended to 2 dimensional arrays, as known from the literature, too.

Let us now consider two linear arrays one (index "l") tilted by +α/2 and the second (index "r") by −α/2, so that both array's normal vectors are tilted by α. Both arrays are electronically steered so that their main beams are looking in the same direction $\alpha_0$. The first array has to be steered to $\alpha_0-\alpha/2$ and the second to $\alpha_0+\alpha/2$. According to Eq 2 are the directions of resulting beams:

$$\theta_{0l}=\sin^{-1}(\sin(\alpha_0-\alpha/2))+\alpha/2 \quad \text{Eq 4}$$

$$\theta_{0r}=\sin^{-1}(\sin(\alpha_0+\alpha/2))-\alpha/2 \quad \text{Eq 5}$$

So $\theta_{0l}=\theta_{0r}=\alpha_0$ and the resulting signals received or transmitted by the arrays will add up coherently.

The grating lobe behavior is different as it is shown in Eq 6 and Eq 7:

$$\theta_{1l} = \sin^{-1}\left(\sin(\alpha_0 - \alpha/2) + \frac{\lambda}{d}\right) + \alpha/2 \quad \text{Eq 6}$$

$$\theta_{1r} = \sin^{-1}\left(\sin(\alpha_0 + \alpha/2) + \frac{\lambda}{d}\right) - \alpha/2 \quad \text{Eq 7}$$

Now it is obvious that $\theta_{1l}\neq\theta_{1r}$, so that the first grating lobe will direct to different solid angles and therefore will have less integration gain as the main beam putting both arrays together. As a result, the ratio between main lobe directivity and first grating lobe directivity will improve. The same is true for all grating lobes entering the real space.

The effect can even be improved having more than two subarrays each tilted against each other. If the arrays are arranged in a two-dimensional grid, and each array has a different normal vector from each other, the resulting grating lobe will be widened up in two dimensions with a significant improvement of the main lobe to grating lobe ratio, especially for large arrays.

In the following several concrete examples of antennas implementing the above described principle are shown.

The array of FIG. 3 approximately is of a circular shape and consists of 97 planar subarrays 100 advantageously arranged in columns and lines. The phase centers of each subarray is indicated by respective dots 101. Each of the subarrays 100 is directed to a different solid angle. Each subarray contains 64 radiating elements 110 (shown as individual dots) advantageously arranged in columns and lines. The 3-D arrangement of the individual subarrays 100 becomes visible from FIG. 4, which shows an enlarged section of FIG. 3 as marked by the square Q in the middle of FIG. 3. FIG. 4 shows nine subarrays 100 each comprising of 64 radiating elements 110. For each subarray 100 the respective normal vectors 120 are illustrated in a 3-D representation.

The face of each subarray is squinting in a different direction. In the exemplary embodiment of FIG. 3 the normal vectors of the subarrays vary gradually from about −3 degree from the left to +3 degree to the right, as well as from the lower to the upper subarrays. The sectional view along A-A shows the resulting convex arrangement of the subarrays within the same line (for a better understanding of the underlying design principle the angles between neighboring subarrays are shown in an excessive way).

In an advantageous embodiment each subarray may be arranged according to a tangential plane touching a virtually taut sphere at its phase centers 101. Thereby a multi-facetted surface of the antenna is built where each facet corresponds to one of the subarrays.

In other words, the antenna surface thus created looks like the spherical segment of a mirror ball. The grid constants of the subarray radiating elements are preferably approximately half the wavelength of the lower operating band avoiding grating lobes in this operation band (the resulting pattern of each subarray is shown in FIG. 1), whereas the pattern in the upper operating band (from known art) will have grating lobes as expected (see FIG. 2).

The signals of each radiating element within a subarray are coherently summed after phase shifting in order to steer the beam, either analog by an appropriate radio frequency combiner or digitally using an analog digital converter behind each radiating element. In the advantageous version of an AESA antenna additionally TRMs are used.

The phase centers 101 of the subarrays shown as white dots in FIG. 3 are then connected for further signal combining.

To form a beam with the exemplary phased array antenna, each subarray has to be steered to a slightly different direction, according to its squint angle and the desired beam direction. In the upper operating band where grating lobes appear each grating lobe will then point to a different direction as described in Eq 6 and Eq 7. As a result of this subarray arrangement the grating lobes will be suppressed by more than 15 dB compared to a planar array at a scanning angle up to +/−15 deg.

FIG. 5 shows three further embodiments of the antenna design according to the invention. The examples are based on a two-dimensional antenna, the subarrays of which are arranged in lines and columns similar to the example shown in FIG. 3.

In each example a cross-sectional view along one column of arrays is shown.

V1: a convex arrangement of the facets/subarrays 100 (e.g. part of the surface of a mirror ball), V2: concave arrangement of the facets/subarrays 100, V3: alternating/irregular arrangement of the facets/subarrays 100.

The related normal vector 120 directions are also shown for each subarray.

In addition, other arrangements of the subarrays are possible. For example, regular or irregular polyhedral arrangements of subarrays may be used. In another example the polyhedral surface of the antenna may approximate a section of an ellipsoid or the like.

The squint angles between the subarrays may be fairly small, in particular if the number of subarrays or the overall seize of the phased array antenna is large. In principle the squint angles are based on an optimization task and are pending on the used array design, size and steering direction.

In the exemplary embodiment of FIG. 3 the squint angles are within the interval [−3,+3] degree for the north-south and west-east direction using the cardinal directions. For larger arrays the angles might even be less than 3 degree, for smaller arrays the angles have to be increased e.g. [−6, +6] degree. In summary, the maximum squint angle depends on the design of the array, number of subarrays and the maximum steering angle of a subarray, so that all subarrays are still able to focus on the same target. The maximum steering angle of the antenna is reduced by the maximum squinting angle of any subarray with respect to the master subarray compared to a planar arrangement. Here, the master subarray is defined as the center for the angle measurement for all other subarrays.

A computer simulation shows this behavior of the grating lobe suppression with a dual-band antenna according to the invention compared to an antenna without the implemented invention using the same number and size of subarrays.

As illustrated in FIG. 6, for a planar subarray arrangement according to prior art grating lobes 200 exist beside the main lobe 10. By contrast, using the inventive dual-band phased array antenna the grating lobes 210 are highly suppressed (see FIG. 7) e.g. about 15 dB at 0.35 Theta/rad compared to the prior art antenna.

Without using the invention the grating lobes 200 are highly disturbing the signal reception and are decreasing the detection quality. However, by usage of the invention these grating lobes are significantly reduced as required.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

LIST OF ABBREVIATIONS

AESA active electronically scanned array
Eq equation
GL grating lobe
ML main lobe
RE radiating element
RF radio frequency
TRM transmit receive module

The invention claimed is:

1. A dual-band phased array antenna with built-in grating lobe mitigation, comprising:

an array of radiating elements configured to operate at both upper and lower bands of the dual bands, wherein the radiating elements of the array are arranged at distances d for avoiding grating lobes with respect to the lower band, the distances d are less than $$\lambda \cdot \frac{1}{1+\sin\frac{\Theta}{2}},$$

λ is a wavelength of the lower band, and Θ is a grating lobe-free scan angle, wherein the radiating elements are arranged in independently steerable planar subarrays, wherein each of the independently steerable subarrays has a different boresight normal vector to mitigate grating lobes in the upper band while coherently adding up signals of the independently steerable planar subarrays to form a beam of the antenna.

2. The dual-band antenna of claim 1, wherein the subarrays are arranged in a polyhedral surface of the antenna.

3. The dual-band antenna of claim 1, wherein the subarrays are arranged lying tangentially on a surface of a virtual sphere.

4. The dual-band antenna of claim 1, wherein the subarrays are arranged, as seen in a boresight direction of the antenna, a rectangular, a circular or a quadratic shape.

5. The dual-band antenna of claim 1, wherein the array of radiating elements is arranged on a mechanically steerable gimbal system.

6. The dual-band antenna of claim 1, wherein the distance d between the radiating elements is smaller than the wavelength $\lambda$.

7. The dual-band antenna of claim 1, wherein the subarrays are arranged in a concave or convex surface of the antenna.

8. The dual-band antenna of claim 7, wherein an angle between the boresight normal vectors of two subarrays located at opposite edges of the antenna is $\leq 6$ degrees.

9. The dual-band antenna of claim 7, wherein an angle between the boresight normal vectors of two subarrays located at opposite edges of the antenna is $\leq 12$ degrees.

10. The dual-band antenna of claim 1, wherein an angle between the boresight normal vectors of any two subarrays is $\leq 6$ degrees.

11. The dual-band antenna of claim 1, wherein an angle between the boresight normal vectors of any two subarrays is $\leq 12$ degrees.

* * * * *